US008176995B1

(12) United States Patent
Polsky et al.

(10) Patent No.: US 8,176,995 B1
(45) Date of Patent: May 15, 2012

(54) REDUCED-IMPACT SLIDING PRESSURE CONTROL VALVE FOR PNEUMATIC HAMMER DRILL

(75) Inventors: Yarom Polsky, Oak Ridge, TN (US); Mark C. Grubelich, Albuquerque, NM (US); Mark R. Vaughn, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 275 days.

(21) Appl. No.: 12/424,583

(22) Filed: Apr. 16, 2009

Related U.S. Application Data

(63) Continuation-in-part of application No. 12/364,600, filed on Feb. 3, 2009, now Pat. No. 8,006,776.

(51) Int. Cl.
*B25D 9/18* (2006.01)
*B25D 9/00* (2006.01)

(52) U.S. Cl. ..... 173/114; 173/13; 173/17; 173/78; 173/79; 173/80; 91/222; 91/327; 91/348; 251/343; 251/344; 251/345; 137/508

(58) Field of Classification Search ..... 173/114, 173/13, 17, 78–80; 91/222, 327, 348; 251/343–345; 137/508
See application file for complete search history.

(56) References Cited

U.S. PATENT DOCUMENTS

| | | | | |
|---|---|---|---|---|
| 4,103,662 | A * | 8/1978 | Kammeraad | 123/188.9 |
| 4,446,929 | A * | 5/1984 | Pillow | 173/17 |
| 4,819,739 | A * | 4/1989 | Fuller | 173/17 |
| 5,085,284 | A | 2/1992 | Fu | |
| 5,301,761 | A | 4/1994 | Fu | |
| 6,131,672 | A * | 10/2000 | Beccu et al. | 173/91 |
| 6,799,641 | B1 | 10/2004 | Lyon et al. | |
| 7,422,074 | B2 | 9/2008 | Meneghini | |

FOREIGN PATENT DOCUMENTS

WO WO 2006075981 A1 * 7/2006

* cited by examiner

*Primary Examiner* — Thanh K Truong
*Assistant Examiner* — Michelle Lopez
(74) *Attorney, Agent, or Firm* — Olivia J. Tsai

(57) ABSTRACT

A method and means of minimizing the effect of elastic valve recoil in impact applications, such as percussive drilling, where sliding spool valves used inside the percussive device are subject to poor positioning control due to elastic recoil effects experienced when the valve impacts a stroke limiting surface. The improved valve design reduces the reflected velocity of the valve by using either an energy damping material, or a valve assembly with internal damping built-in, to dissipate the compression stress wave produced during impact.

18 Claims, 15 Drawing Sheets

REDUCED-IMPACT SLIDING PRESSURE CONTROL VALVE FOR PNEUMATIC HAMMER DRILL

CROSS-REFERENCE TO RELATED APPLICATIONS

This application is a Continuation-in-Part of U.S. patent application Ser. No. 12/364,600 filed Feb. 3, 2009 now U.S. Pat. No. 8,006,776, which is incorporated herein by reference.

FEDERALLY SPONSORED RESEARCH

The United States Government has rights in this invention pursuant to Department of Energy Contract No. DE-AC04-94AL85000 with Sandia Corporation.

BACKGROUND OF THE INVENTION

The present invention relates to control of percussive hammer devices, such as pneumatic percussion drills and rock breakers.

A downhole pneumatic hammer is, in principle, a simple device consisting of a ported air feed conduit, more commonly known as a feed tube, check valve assembly above the feed tube to preventingress of wellbore fluids into the drill, a reciprocating piston, a case, a drill bit, and associated retaining hardware. The typical valveless device, for example, possesses on the order of 15 components. The reciprocation of the piston is accomplished by sequentially feeding high-pressure air to either the power chamber of the case (the volume that when pressurized moves the piston towards the bit shank) or return chamber of the case. The regulation of the air flow can be accomplished either by use of passages (e.g., slots, grooves, ports) machined into the feed tube, piston body, or hammer case; or a combination of active valving and porting through either the piston, the case, or an additional sleeve.

However, existing designs do not provide the most efficient use of the total air energy available because they have built-in inherent inefficiencies. The present invention greatly reduces these inefficiencies.

Impact applications, such as percussive drilling, that utilize sliding valves to control fluid flow (usually a gas) within the device are subject to control difficulties if the valve is not properly located relative to port positions during a cycle. Misalignments and mis-positionings of the valve can result in poor regulation of the device pressure chambers. Standard valve materials, such as steels or high strength plastics, are stiff and have very little internal damping, leading to predominantly elastic impact collisions in which almost all of the impact velocity of the component is preserved in rebound.

A typical configuration consists of an air feed conduit (tube), a reciprocating piston, and a spool valve within the piston. During operation, the air feed conduit is stationary, the piston reciprocates bi-directionally along the feed conduit axis, and the valve moves within the piston covering radial ports in the piston at different points in the cycle to regulate air flow that is used to control the piston's motion. In applications where rapid velocity reversals of the piston occur (e.g., hammer drilling), the valve within the piston tends to recoil elastically off the position-limiting surfaces of the piston. This recoil often causes the valve to unintentionally cover, or expose, the incorrect ports, leading to control or performance problems.

Against this background, the present invention was developed.

SUMMARY OF THE INVENTION

The present invention relates to a method and means of minimizing the effect of elastic valve recoil in impact applications, such as percussive drilling, where sliding spool valves used inside the percussive device are subject to poor positioning control due to elastic recoil effects experienced when the valve impacts a stroke limiting surface. The improved valve design reduces the reflected velocity of the valve by using either an energy damping material, or a valve assembly with internal damping built-in, to dissipate the compression stress wave produced during impact.

BRIEF DESCRIPTION OF THE DRAWINGS

The accompanying drawings, which are incorporated in and form part of the specification, illustrate various examples of the present invention and, together with the detailed description, serve to explain the principles of the invention.

DETAILED DESCRIPTION OF THE INVENTION

The present invention is of a reduced-impact sliding feed tube pressure control valve for reciprocating hammer drills that is more efficient and produces more drilling power. Typically these are pneumatic (air) percussive drills, but could also use other motive fluids (such as water, steam or gas other than air).

Figure 1A:
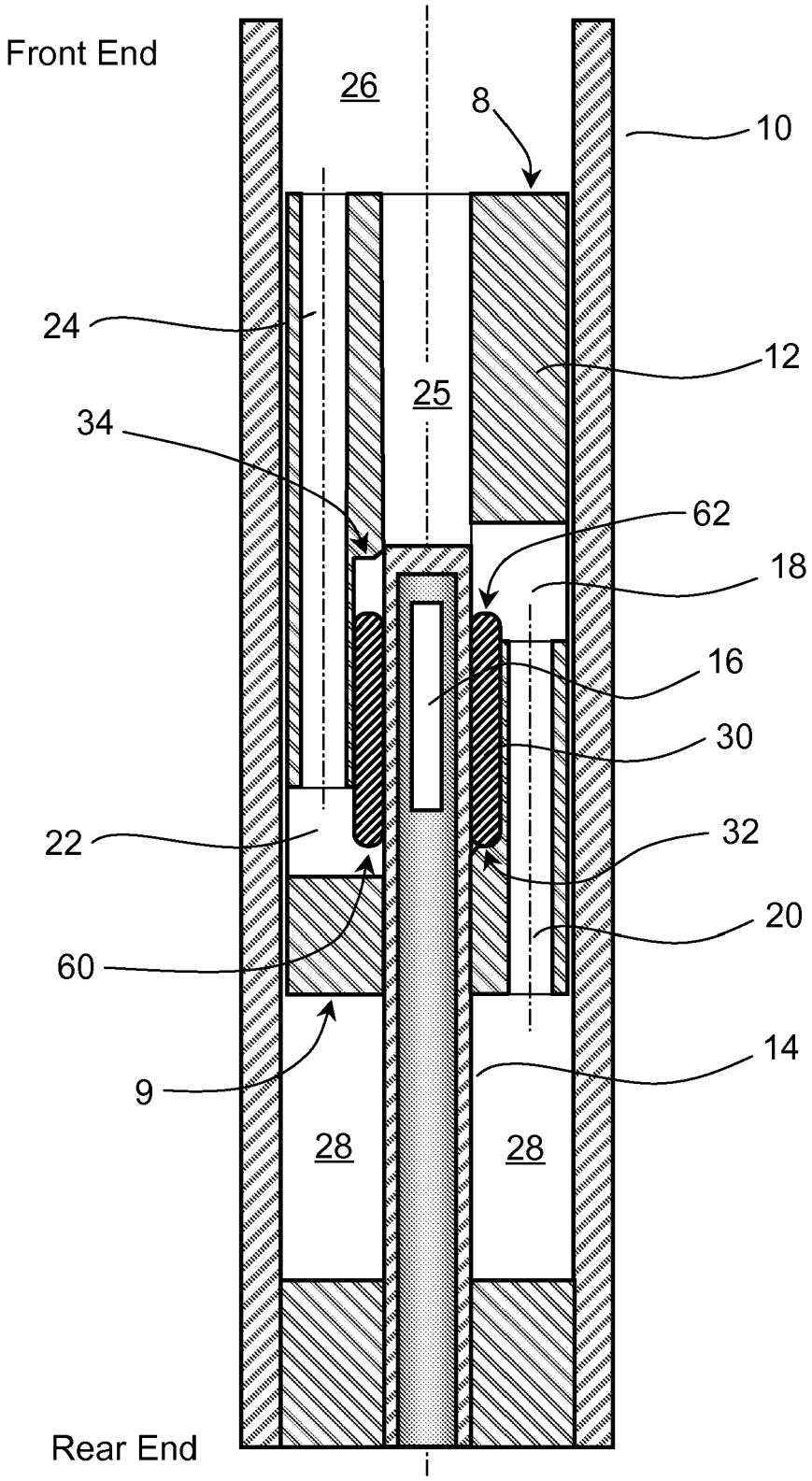
FIG. 1A shows a schematic cross-section view of a pneumatic hammer device with a reduced-impact sliding valve, according to the present invention.

FIG. 1A shows a schematic cross-section side view of the present invention, which comprises outer casing 10, reciprocating piston 12, front end face 8, rear end face 9, air feed tube 14, air feed slot 16 (two of them, 180 degrees apart), rear supply port side-hole 18, rear supply port 20, front supply port side-hole 22, front supply port 24, central piston bore 25, return chamber 26 (also known as the forward/front chamber), power chamber 28 (also known as the rear chamber), sliding valve 30, rear piston inner shoulder 32, and front piston inner shoulder 34. This device comprises a mechanical means of regulating the flow of air or other motive fluid to the power and return chambers of a percussive hammer device (e.g., hammer drill); although, in principle, this regulation scheme can be applied to any application where control over the reciprocation of a piston-like element is desired based on its stroke position. The device provides the ability to regulate the flow of air into both the power and return chamber.

The mechanical form of the regulating mechanism (i.e., valve 30) is a "spool" or a "sleeve" that is positioned between the piston 12 of the device and air distributor 14 (or "feed tube", as it is called in downhole hammer drilling devices). The spool valve 30 acts to cover (partially, or fully) and, thereby isolate, the two side ports 18 and 22 that convey motive fluid to the device's rear (power) chamber 28 and forward (return) chamber 26, respectively.

The position of the spool is controlled by the application of fluid pressure to the spool's exposed end faces 60 and 62. End faces 60 and 62 can be rounded, as illustrated in FIG. 1, or square-ended, or chamfered, or slanted. The pressure is determined by controlled dimensioning of the sliding spool valve 30, and controlled location of the porting (air feed slot 16) in the air distributor or "feed tube" 14. The piston's side-holes 18 and 22 (ports perpendicular to the main axis) can be oversized, elongated slots.

Figure 1B:
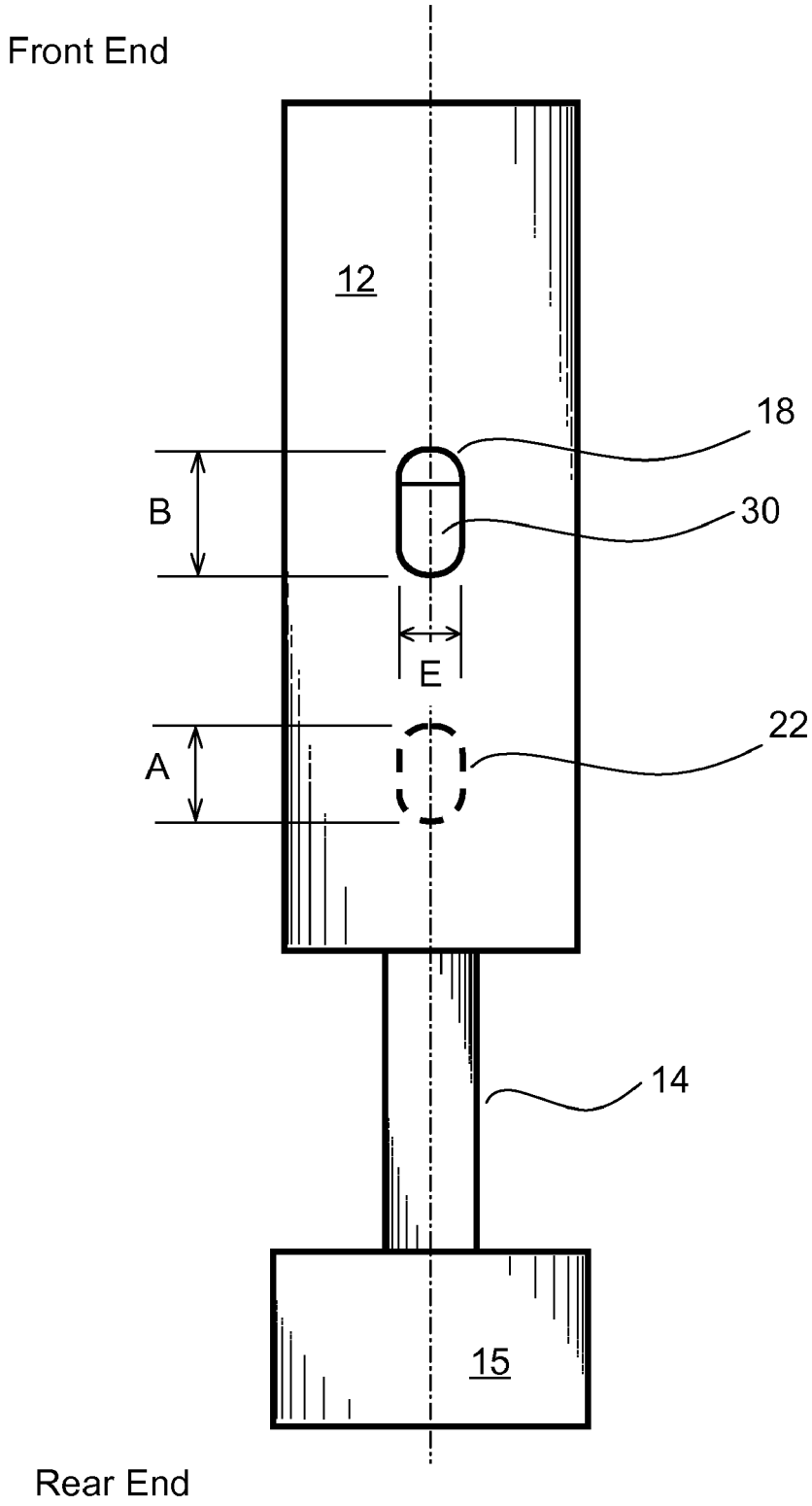
FIG. 1B shows a schematic side view of the exterior of a pneumatic hammer device with a reduced-impact sliding valve, according to the present invention.

FIG. 1B shows a schematic side view of the exterior of a pneumatic hammer device with a reduced-impact sliding valve, according to the present invention. Piston 12 has an elongated slot-shaped side-hole (port) 18 with axial length, B, and circumferential width, E, and full-radius ends. Sliding spool valve 30 can be seen through side-hole 18. The other side-hole, 22, is hidden in this view because it is located 180° around on the opposite side of piston 12. In one embodiment, B can equal two times E.

Figure 1C:
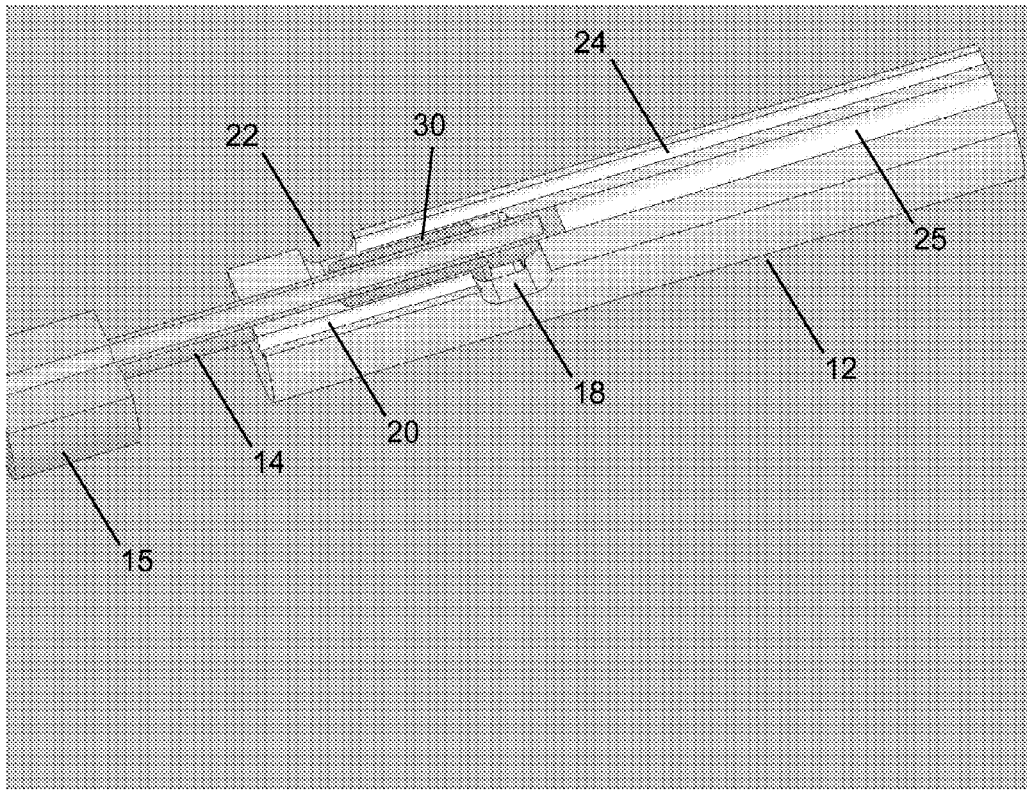
FIG. 1C shows an isometric, solid-shaded, cut-away view of a pneumatic hammer device with a reduced-impact sliding valve, according to the present invention.

FIG. 1C shows an isometric, solid-shaded, cut-away view of a pneumatic hammer device with a reduced-impact sliding valve, according to the present invention. The part numbers match those of FIGS. 1A and 1B.

Figure 12:
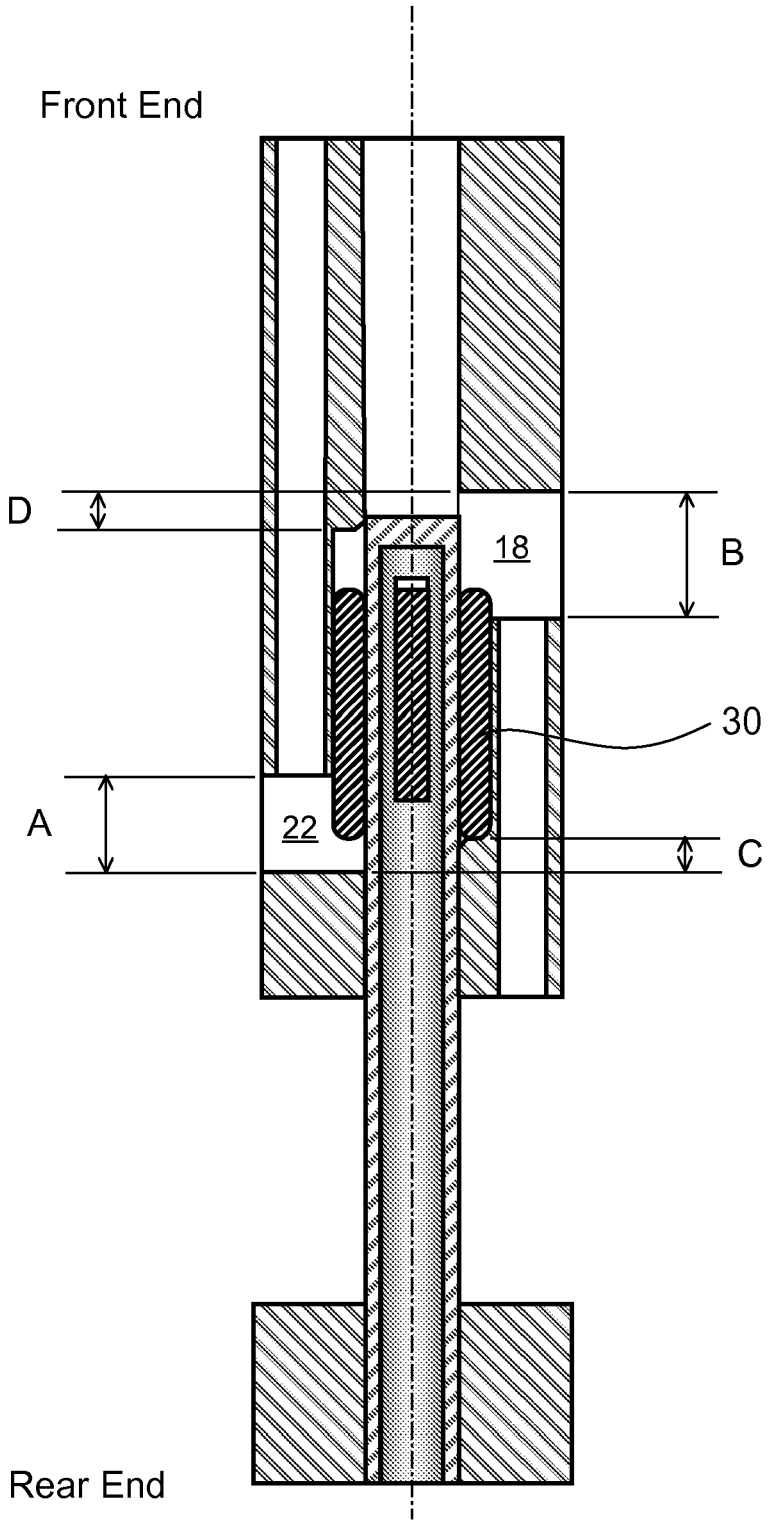
FIG. 12 shows a schematic cross-section view of a pneumatic hammer device with a reduced-impact sliding valve, according to the present invention.

FIG. 12 shows that, in one embodiment, the axial length, B, of elongated rear supply port side-hole 18 is greater than the axial length, A, of elongated front supply port side-hole 22. For example, the axial length, B, of the rear supply port side-hole 18 can be 1.5 times longer than the axial length, A, of the front supply port side-hole 22. The different lengths (i.e., A not equal to B), allows for asymmetric timing between the power and return cycles. Alternatively, A can equal B. Alternatively, A can equal 1.5 times E. Generally, the circumferential width (E) of the side-holes 18 and 22 are the same.

In FIG. 12, the spool valve 30 does not completely overlap the side-holes 18 and 22 at the ends of its travel, thereby permitting fluid flow around it, and, hence, pressure to be applied to the valve's end surfaces to move it when it is at its extreme limit positions. This reduces the impact forces. Valve 30 shuttles/slides back and forth in-between a pair of hard limit stops: rear piston internal shoulder 32, and front piston internal shoulder 34.

Figure 13:
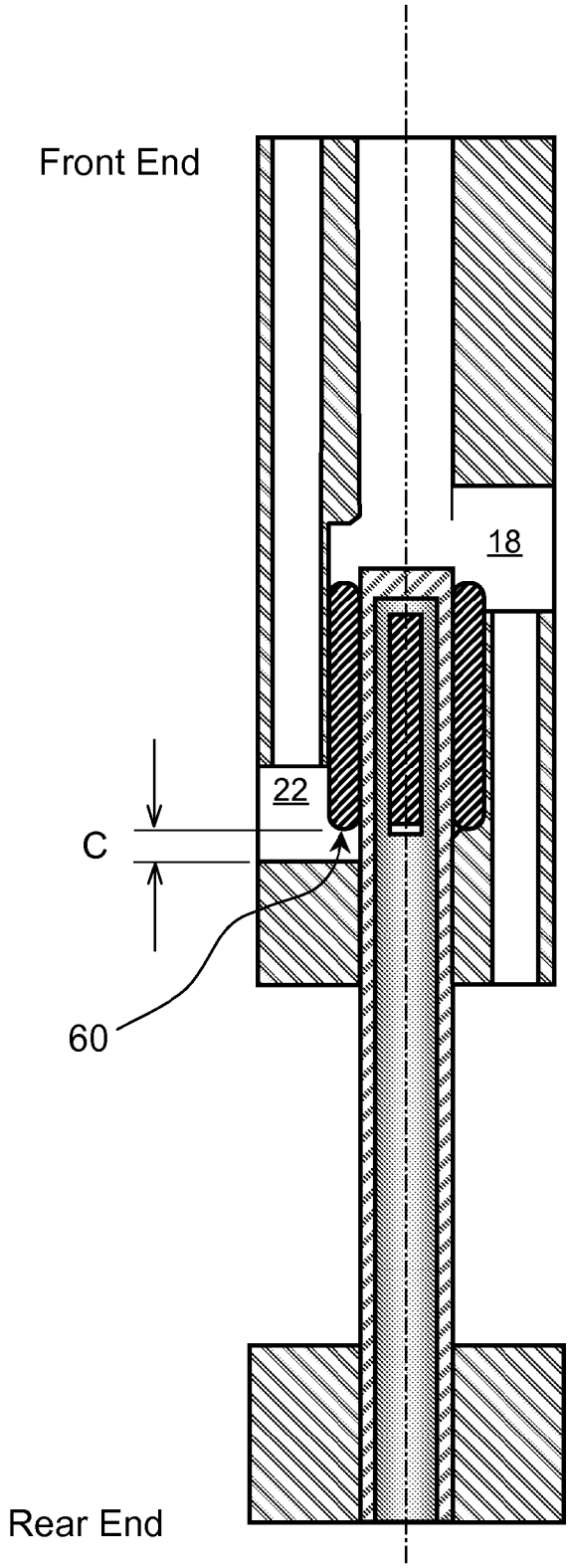
FIG. 13 shows a schematic cross-section view of a pneumatic hammer device with a reduced-impact sliding valve, according to the present invention.

FIG. 13 shows that when valve 30 is at its rearward most position (limited by rear piston internal shoulder 32), the distance "C" is greater than zero. The gap distance "C" is determined by the position at which the rear piston internal shoulder 32 is located relative to the rearward-most extent of front supply port side-hole 22. In one embodiment, the distance "C" can be about ⅓ of the distance "A" (see FIG. 12). This means that valve 30 leaves about ⅓ of the area of side-hole 22 open/uncovered when valve 30 is at its rear limit position. With this configuration, valve 30 is not able to completely close and block airflow through front supply port side-hole 22. This permits the air pressure to apply a forward-facing force to the valve's rearward facing end surface 60, which changes the motion and timing of the valve 30 during a piston cycle. In other words, the purpose of the inner shoulder(s) is to provide a pathway for air to pressurize the valve's face(s) when it is seated. Without the gap under the valve, there is no way for air to get under the valve; unless it has already started to unseat.

Figure 14:
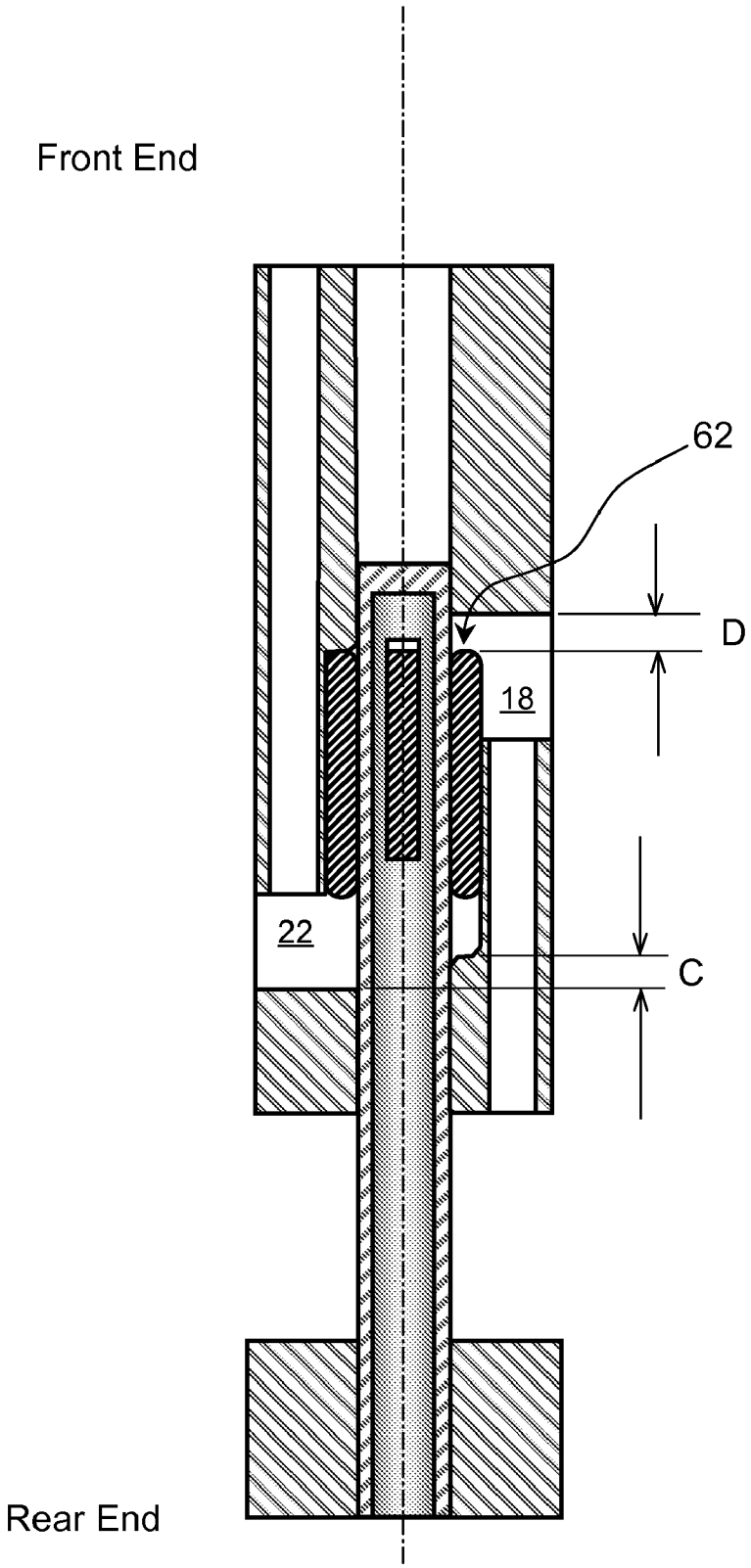
FIG. 14 shows a schematic cross-section view of another pneumatic hammer device with a reduced-impact sliding valve, according to the present invention.

FIG. 14 shows that, in another embodiment, when valve 30 is at its forward most position (limited by front piston internal shoulder 34), the distance "D" is greater than zero. In one embodiment, the distance "D" can be about ¼ of the distance "B" (see FIG. 12). This means that valve 30 leaves about ¼ of the area of side-hole 18 open/uncovered when valve 30 is at its forward most limit position. In other words, valve 30 is not able to completely close and block airflow through rear supply port side-hole 18. This permits the air pressure to apply a rearward-facing force to the valve's forward facing end surface 62, which changes the motion and timing of the valve 30 during a piston cycle. The gap distance "D" is determined by the position at which the front piston internal shoulder 34 is located relative to the forward-most extent of rear supply port side-hole 18.

Figure 2:
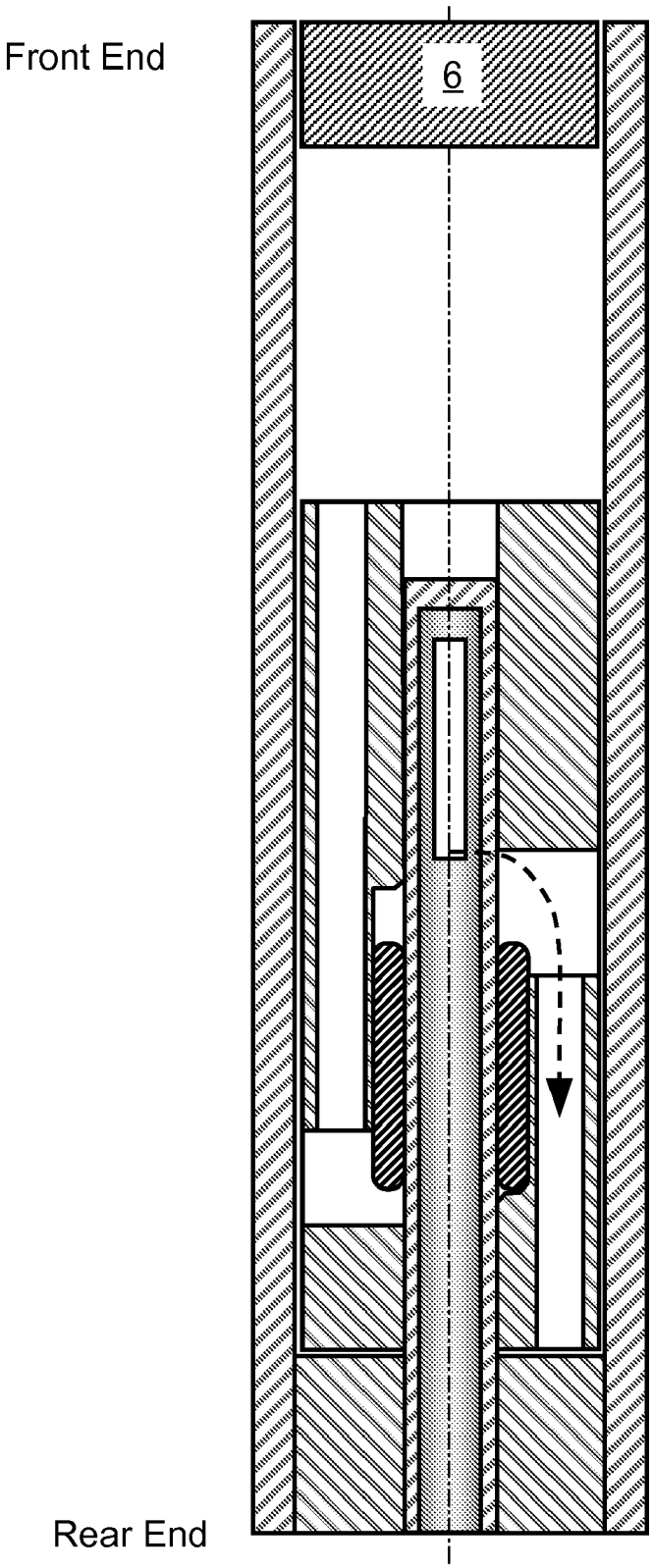
FIG. 2 shows a schematic cross-section view of a pneumatic hammer device with a reduced-impact sliding valve, according to the present invention.
Figure 3:
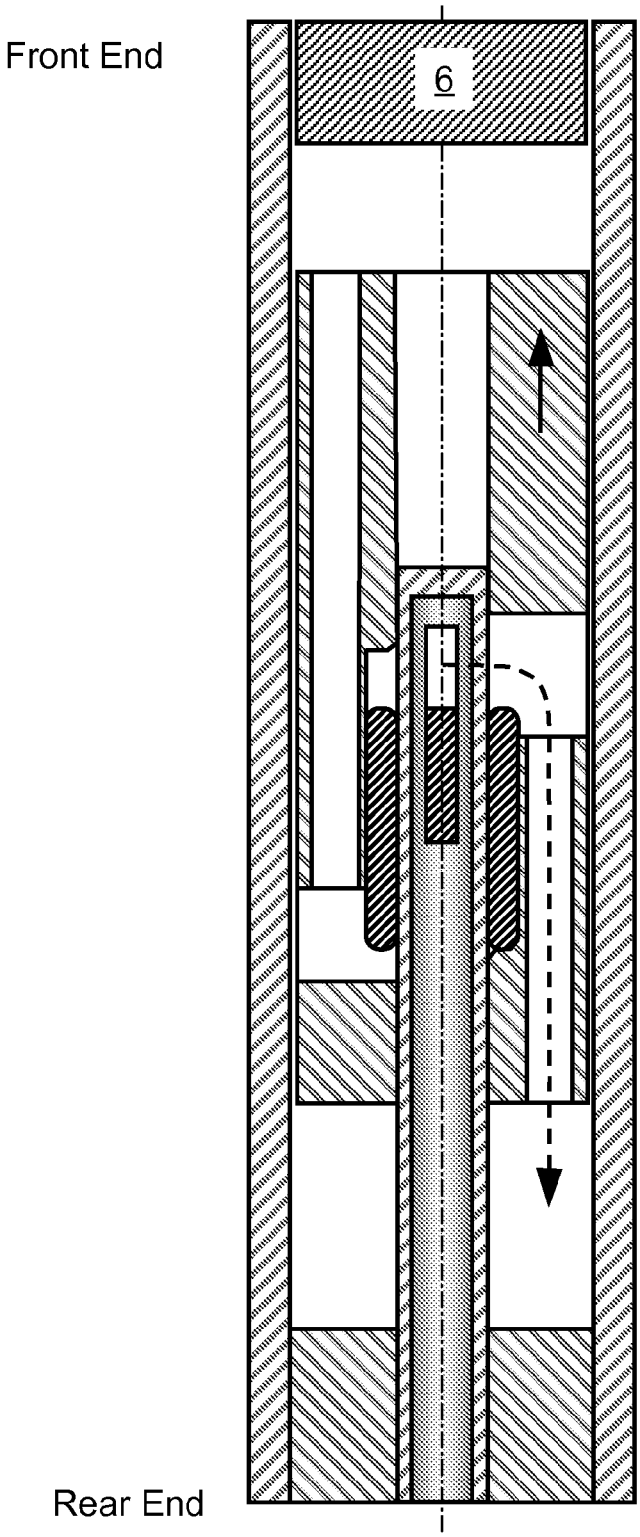
FIG. 3 shows a schematic cross-section view of a pneumatic hammer device with a reduced-impact sliding valve, according to the present invention.
Figure 4:
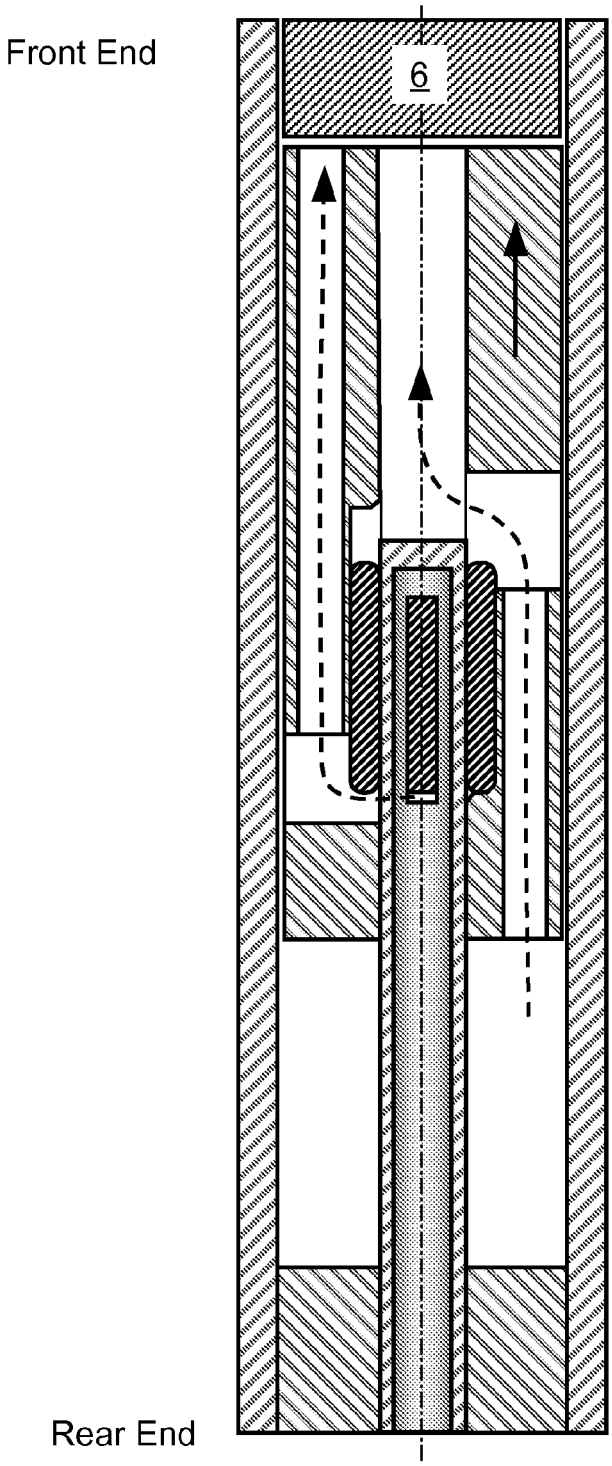
FIG. 4 shows a schematic cross-section view of a pneumatic hammer device with a reduced-impact sliding valve, according to the present invention.
Figure 5:
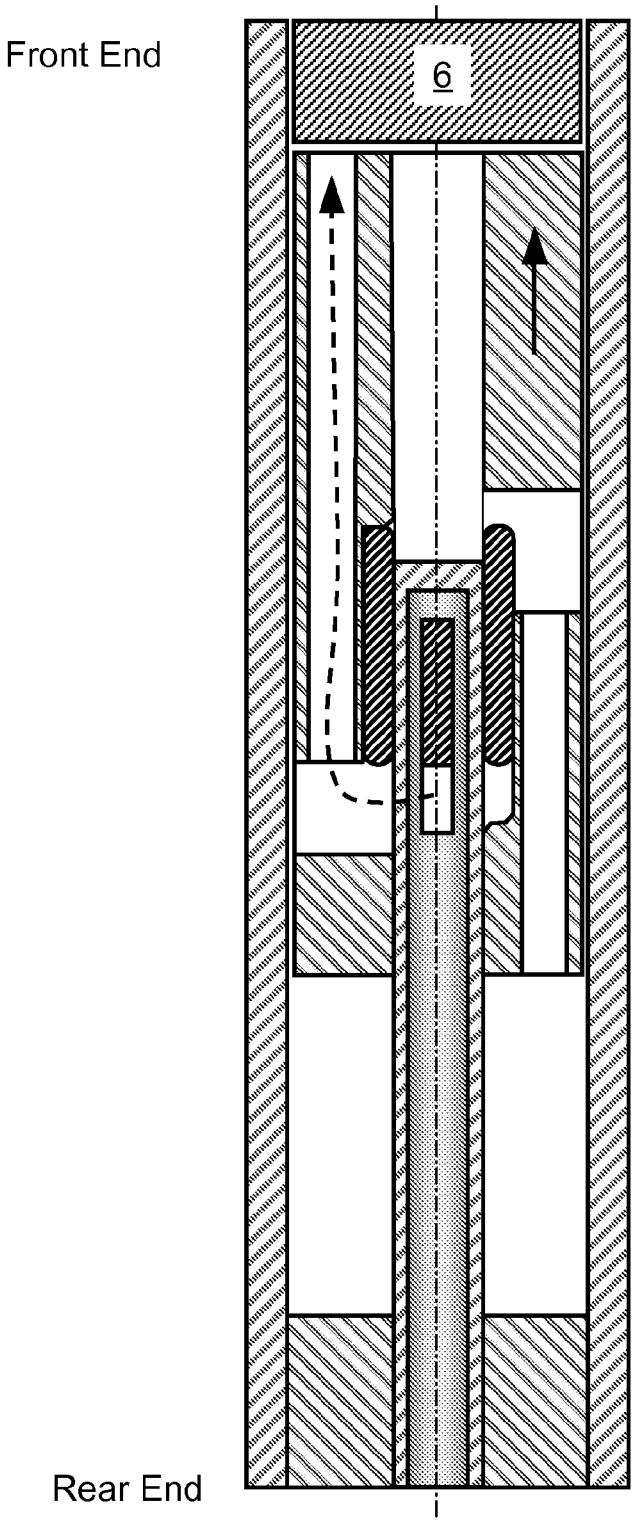
FIG. 5 shows a schematic cross-section view of a pneumatic hammer device with a reduced-impact sliding valve, according to the present invention.
Figure 6:
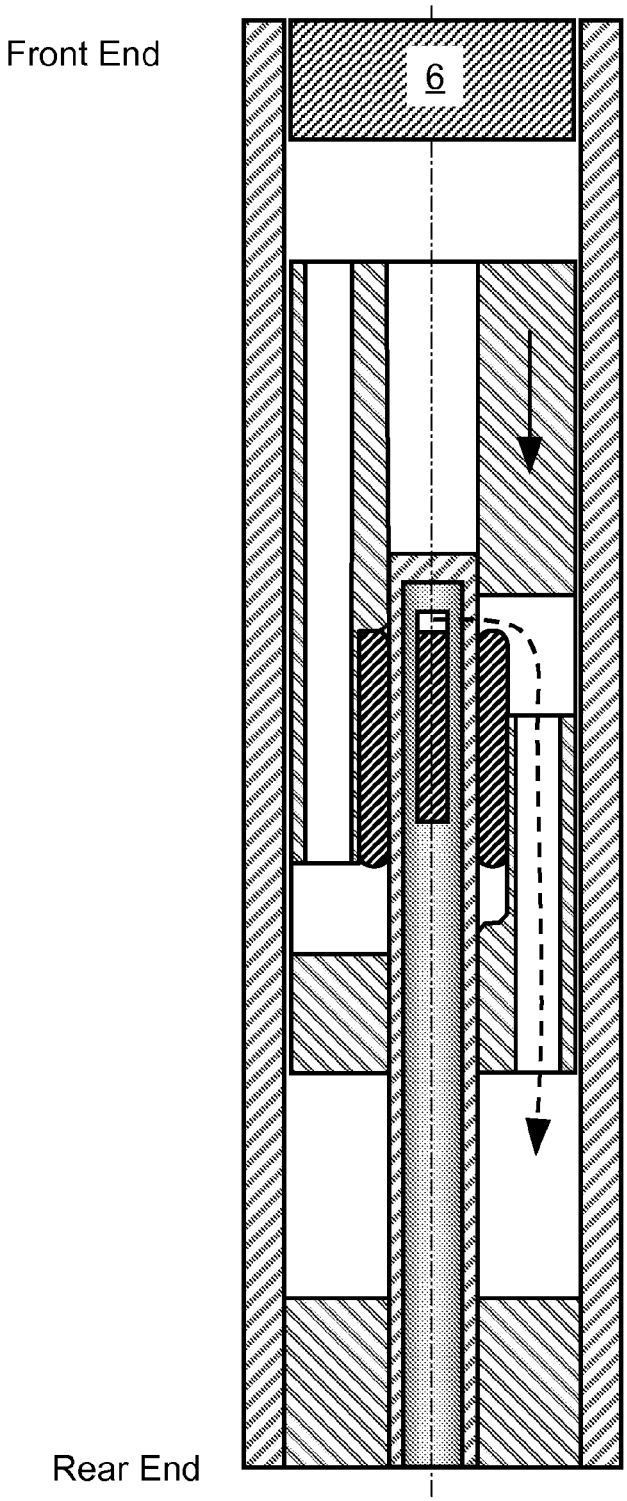
FIG. 6 shows a schematic cross-section view of a pneumatic hammer device with a reduced-impact sliding valve, according to the present invention.
Figure 7:
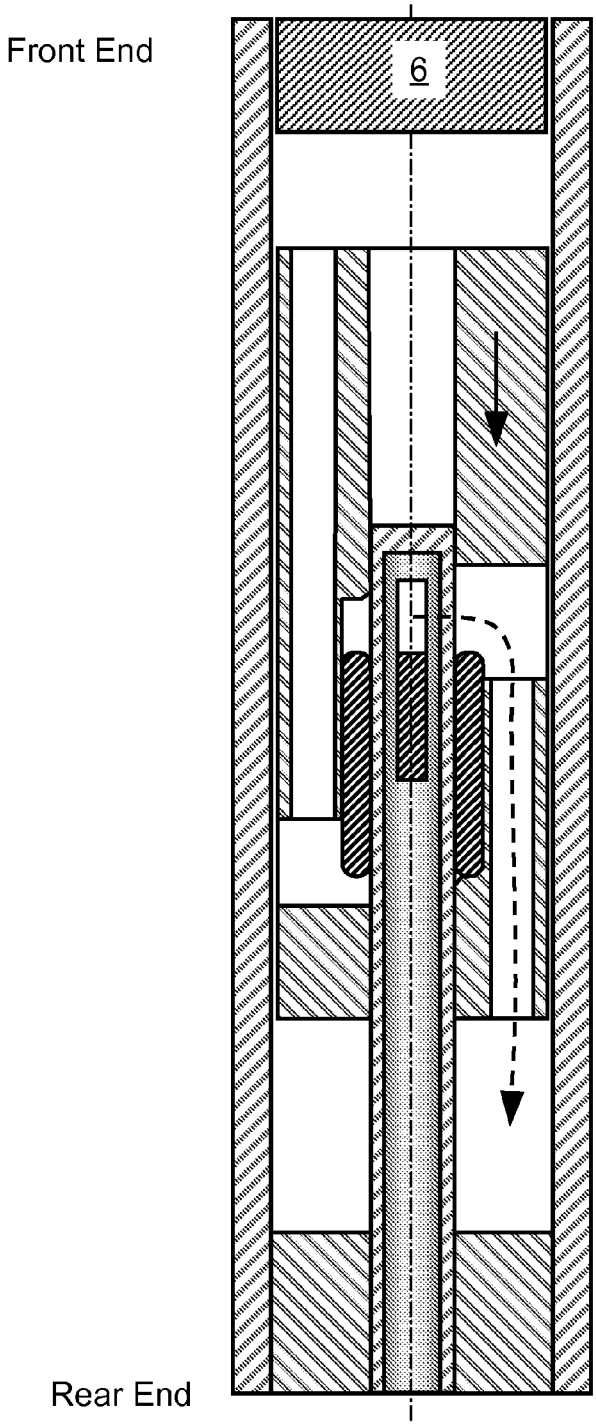
FIG. 7 shows a schematic cross-section view of a pneumatic hammer device with a reduced-impact sliding valve, according to the present invention.

A complete cycle is shown in FIGS. 2-7. FIG. 2 shows the minimum piston position during power stroke—pressure inside rear supply port 20 and rear supply port side-hole 18 forces spool 30 to cover most of forward supply port side-hole 22, partially blocking front supply port 24. FIG. 3 shows the piston's middle position during power stroke; air supply to rear chamber 28 continues. FIG. 4 shows beginning rear vent during power stoke—the spool is still blocking forward supply port; and rear chamber begins to vent. FIG. 5 shows to spool shifted forward up against the front piston shoulder 34, prior to piston impact at the top (e.g., impacting on a drill bit 6). In FIG. 5, the feed tube slot 16 begins to supply the non-overlapped area of the forward chamber supply port 24, which shifts the spool forward, along with impact, and allows full pressurization of forward chamber 26. Note that the rear supply port 20 is simultaneously partially blocked, changing the point in the stroke at which the feed tube will connect with this port. FIG. 6 shows continuing to supply air to the forward chamber 26 on initiation of return stroke. Finally, FIG. 7 shows beginning supply air to the rear supply port 20 on return stroke; when the feed tube slot passes the spool, the spool shifts back to the rear (limited by the rear piston inner shoulder 32), to supply the rear chamber 28, and to partially cover the front chamber supply port 22 and 24. Note: this occurs closer to the rear than on the power stroke, because of the shifted spool position.

The intention of this approach is threefold: (1) to prevent pressurization of forward chamber 26 during power stoke; (2) to increase length of pressurization of rear chamber 28 during power stroke; and (3) to decrease length of pressurization of rear chamber 28 during power stroke (to increase overall stroke length).

The spool valve 30 can be inserted after counter-boring the rear side of the piston, and installing an end cap tube to create the confining surface.

Figure 8:
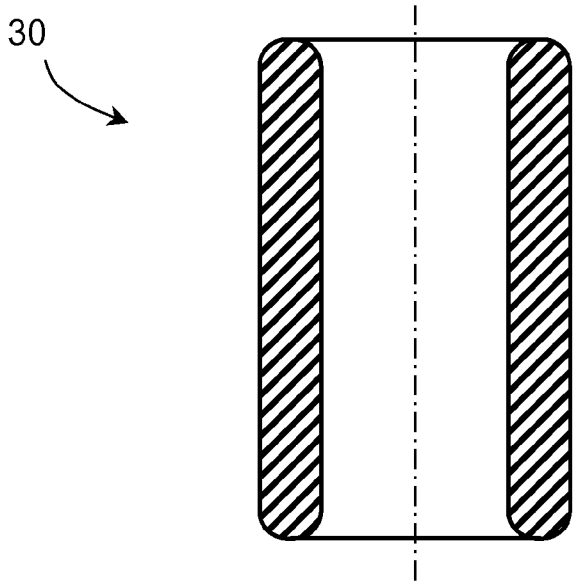
FIG. 8 shows a schematic cross-section view of a standard sliding valve.

Impact applications, such as percussive drilling, that utilize sliding valves to control fluid flow within the device are subject to control difficulties if the valve is not properly located relative to port positions during a cycle. Misalignments and mis-positionings can result in premature fatigue damage and breakage of the valve, control tube, or other parts inside the drill. Standard valve materials, such as steels or high strength plastics (see, e.g. FIG. 8), are stiff and have very little internal damping, leading to predominantly elastic impact collisions in which almost all of the impact velocity of the component is preserved in rebound.

A reduced-impact spool valve, according to the present invention, involves the use of either energy damping material or an energy damping valve assembly to reduce rebound velocity (and, hence, impact forces). Three examples of improved designs are given.

Figure 9A:
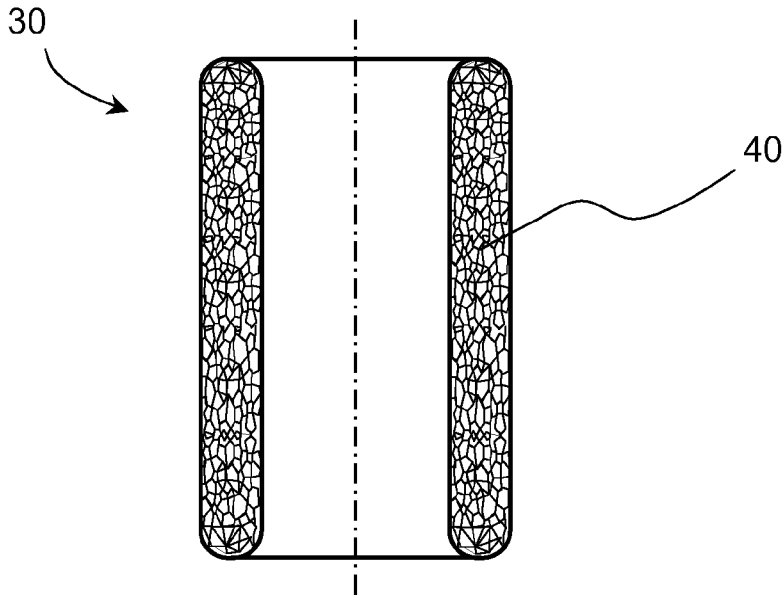
FIG. 9A shows a schematic cross-section view of a reduced-impact sliding valve, according to the present invention.
Figure 9B:
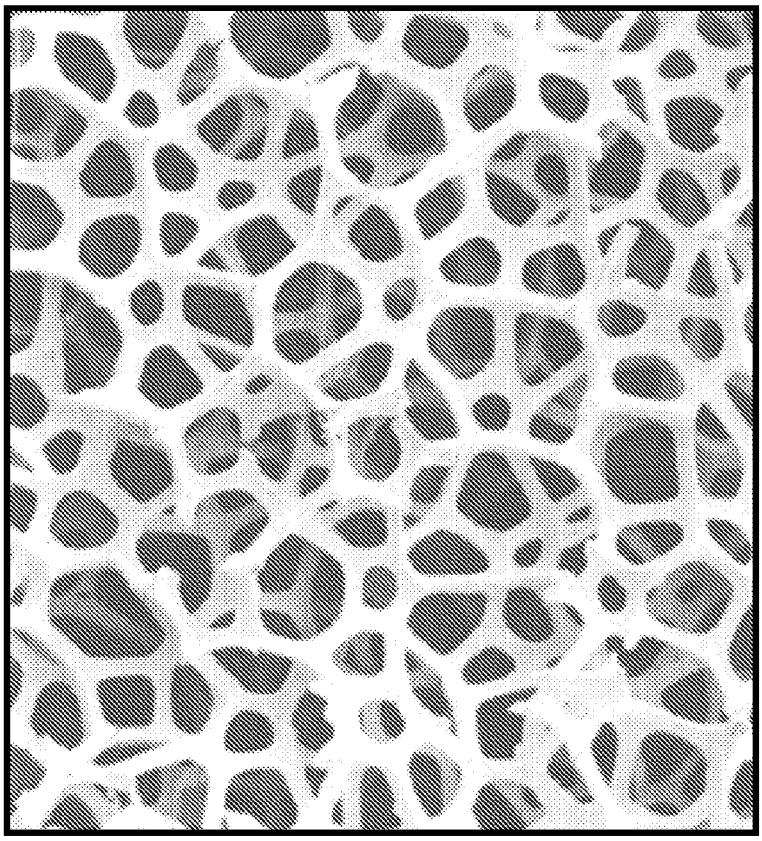
FIG. 9B shows a cross-section photomicrograph of a reticulated network of silicon carbide foam.

One design for reducing valve recoil is to fabricate the valve from a material with high internal energy damping (see FIG. 9A), such as a metallic or ceramic foam core 40 (e.g., Aluminum or SiC reticulated foam made by near-net shape chemical vapor infiltration techniques, see FIG. 9B), with or without a solid skin.

Figure 10:
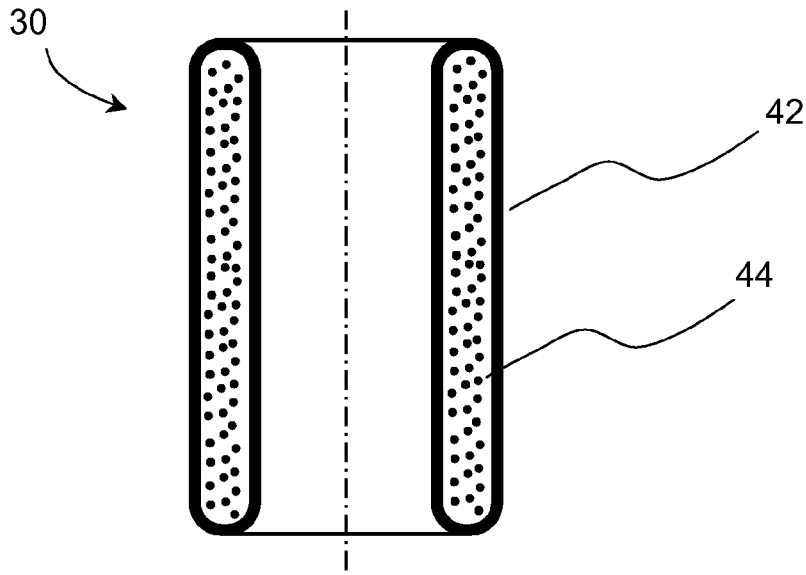
FIG. 10 shows a schematic cross-section view of another reduced-impact sliding valve, according to the present invention.

A second design, shown in FIG. 10, comprises an external shell 42 filled with small particles or pellets/balls 44; such that when impact occurs, the impact stress wave propagating through the interior will be dissipated by interaction between the particles. Additionally, the interior of shell 42 can also be filled with a fluid, such as a high viscosity oil, to provide further damping.

Figure 11:
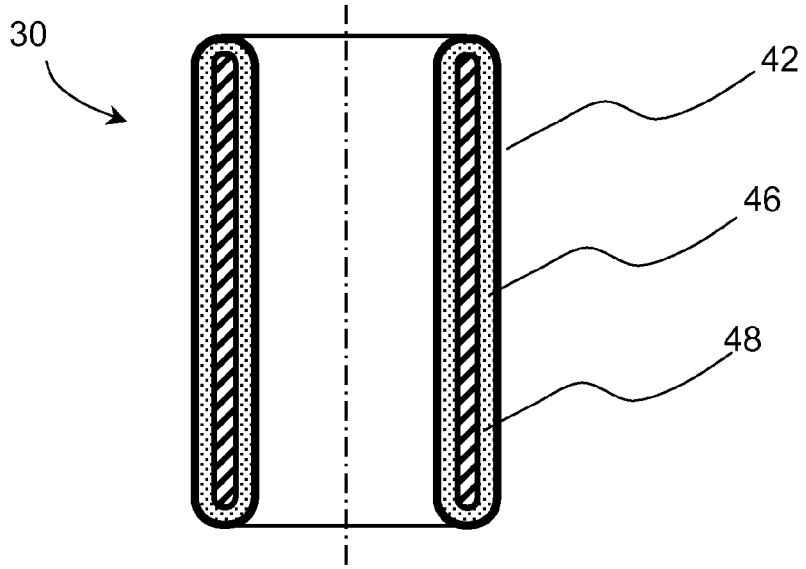
FIG. 11 shows a schematic cross-section view of another reduced-impact sliding valve, according to the present invention.

A third design, shown in FIG. 11, comprises an external shell 42 filled with a high viscosity, damping fluid 46 (e.g., an oil) and a freely-moving sliding internal sleeve 48 disposed inside of the shell 42. In this embodiment, recoil reduction is accomplished through: (a) energy dissipation/damping between the sliding sleeve 48 and viscous oil 46, and (b) through using the internal sleeve 48 to provide a counter-impact (delayed impact) to the external shell 42, after the shell 42 strikes either of the piston's internal shoulder stops 32 or 34 (see FIG. 1A). With respect to the latter, internal sleeve 48 and external shell 42 both move in the same direction, with the same velocity, prior to valve impact. After valve impact, the external shell's velocity is reversed, while the sliding internal sleeve 48 continues to move in the same direction; until it impacts the shell's end. Because the external shell 42 and internal sleeve 48 have momentum values of opposite sign, the net momentum of the entire two-part assembly is reduced, and the velocity of the assembly 30 after impact is significantly reduced. In this sense, the internal sleeve 48 acts as a counter-weight. Internal sleeve 48 can be made of a heavier (more dense) material, such as steel.

Alternatively, in FIG. 11, internal sleeve 48 can have longitudinal or circumferential or spiral-running vanes, ribs, grooves, or knurled surface on the outer or inner surfaces (or both), to modify the friction between sleeve 28 and damping fluid 46. Alternatively, sleeve 48 can have a pattern of small holes drilled through the sleeve to also affect the friction. Alternatively, sleeve 48 can be made of a porous ceramic or metal material (as described above) to also affect the friction.

The scope of the invention is defined by the claims appended hereto.

What is claimed is:

1. A pneumatic hammer drill with a reduced-impact sliding pressure control valve, comprising:

a cylindrical casing;

an air feed tube, supported along the central axis of the casing, with at least one air distribution slot cut into the distal end of the feed tube;

a reciprocating piston, comprising:

a front end face and a rear end face, disposed inside the casing; a central bore hole sized to fit closely over the feed tube that allows the piston to reciprocate forward and back along the air feed tube;

a rear supply port fluidically connected to the rear end face and to a rear supply port side-hole in the piston that is fluidically connected to the central bore hole;

a front supply port fluidically connected to the front face and to a front supply port side-hole in the piston on the opposite side circumferentially from the rear supply port side-hole, that is fluidically connected to the central bore hole;

a front piston inner shoulder; and a rear piston inner shoulder; and a reduced-impact sliding spool valve disposed over the air feed tube, inside of the piston, with forward and rear limit stop positions defined by the front piston inner shoulder and by the rear piston inner shoulder, respectively;

wherein the reduced-impact sliding spool valve comprises a thin metallic shell filled with particles or balls.

2. The pneumatic hammer drill of claim 1, wherein the front piston inner shoulder is located at a first axial position so that when the spool valve is shifted towards the front end face, the valve does not completely cover and block the rear supply port side-hole; and further wherein the rear piston inner shoulder is located at a second axial position so that when the spool valve is shifted towards the rear end face, the valve does not completely cover and block the front supply port side-hole.

3. The pneumatic hammer drill of claim 2, wherein the axial position of the rear piston inner shoulder is chosen so that when the spool valve is shifted towards the rear end face, the spool valve leaves about ⅓ of a flow area of the front supply port side-hole open and uncovered.

4. The pneumatic hammer drill of claim 2, wherein the axial position of the front piston inner shoulder is chosen so that when the spool valve is shifted towards the front end face, the spool valve leaves about ¼ of a flow area of the rear supply port side-hole open and uncovered.

5. The pneumatic hammer drill of claim 2, wherein the axial length, B, of the elongated rear supply port side-hole is equal to two times the circumferential width, E, of said elongated rear supply port side-hole.

6. The pneumatic hammer drill of claim 2, wherein the axial length, A, of the elongated front supply port side-hole is equal to 1.5 times the circumferential width, E, of said elongated front supply port side-hole.

7. The pneumatic hammer drill of claim 1, wherein both the front supply port side-hole and the rear supply port side-hole have an elongated, slot-like opening that is longer in the axial direction than its circumferential width.

8. The pneumatic hammer drill of claim 7, wherein the axial length, B, of the elongated rear supply port side-hole is greater than the axial length, A, of the elongated front supply port side-hole.

9. The pneumatic hammer drill of claim 8, wherein the axial length, B, of the elongated rear supply port side-hole is 1.5 times greater than the axial length, A, of the elongated front supply port side-hole.

10. A pneumatic hammer drill with a reduced-impact sliding pressure control valve, comprising:

a cylindrical casing;

an air feed tube, supported along the central axis of the casing, with at least one air distribution slot cut into the distal end of the feed tube;

a reciprocating piston, comprising:

a front end face and a rear end face, disposed inside the casing; a central bore hole sized to fit closely over the feed tube that allows the piston to reciprocate forward and back along the air feed tube;

a rear supply port fluidically connected to the rear end face and to a rear supply port side-hole in the piston that is fluidically connected to the central bore hole;

a front supply port fluidically connected to the front face and to a front supply port side-hole in the piston on the opposite side circumferentially from the rear supply port side-hole, that is fluidically connected to the central bore hole;

a front piston inner shoulder; and a rear piston inner shoulder; and a reduced-impact sliding spool valve disposed over the air feed tube, inside of the piston, with forward and rear limit stop positions defined by the front piston inner shoulder and by the rear piston inner shoulder, respectively;

wherein the reduced-impact sliding spool valve comprises an external shell and an internal sleeve disposed inside of the external shell that acts as counterweight and the reduced-impact sliding spool valve has a high viscosity fluid disposed in-between the external shell and the internal sleeve.

11. The pneumatic hammer drill of claim 10, wherein the front piston inner shoulder is located at a first axial position so that when the spool valve is shifted towards the front end face, the valve does not completely cover and block the rear supply port side-hole; and further wherein the rear piston inner shoulder is located at a second axial position so that when the spool valve is shifted towards the rear end face, the valve does not completely cover and block the front supply port side-hole.

12. The pneumatic hammer drill of claim 11, wherein the axial position of the rear piston inner shoulder is chosen so that when the spool valve is shifted towards the rear end face, the spool valve leaves about ⅓ of a flow area of the front supply port side-hole open and uncovered.

13. The pneumatic hammer drill of claim 11, wherein the axial position of the front piston inner shoulder is chosen so that when the spool valve is shifted towards the front end face, the spool valve leaves about ¼ of a flow area of the rear supply port side-hole open and uncovered.

14. The pneumatic hammer drill of claim 11, wherein the axial length, B, of the elongated rear supply port side-hole is equal to two times the circumferential width, E, of said elongated rear supply port side-hole.

15. The pneumatic hammer drill of claim 11, wherein the axial length, A, of the elongated front supply port side-hole is equal to 1.5 times the circumferential width, E, of said elongated front supply port side-hole.

16. The pneumatic hammer drill of claim 10, wherein both the front supply port side-hole and the rear supply port side-hole have an elongated, slot-like opening that is longer in the axial direction than its circumferential width.

17. The pneumatic hammer drill of claim 16, wherein the axial length, B, of the elongated rear supply port side-hole is greater than the axial length, A, of the elongated front supply port side-hole.

18. The pneumatic hammer drill of claim 17, wherein the axial length, B, of the elongated rear supply port side-hole is 1.5 times greater than the axial length, A, of the elongated front supply port side-hole.

* * * * *